United States Patent [19]

Neary et al.

[11] Patent Number: 4,604,879

[45] Date of Patent: Aug. 12, 1986

[54] CYLINDRICAL LOCK

[75] Inventors: Ralph E. Neary, San Francisco; Scott A. Hull, Burlingame, both of Calif.

[73] Assignee: Schlage Lock Company, San Francisco, Calif.

[21] Appl. No.: 590,326

[22] Filed: Mar. 16, 1984

[51] Int. Cl.[4] ..... E05B 13/10; E05B 3/00

[52] U.S. Cl. ..... 70/224; 70/451; 70/466; 292/348; 292/356; 411/195

[58] Field of Search ..... 292/350, 356, 357, 348; 70/209, 210, 215, 224, 466, 451, 452; 411/192–195, 202, 203

[56] References Cited

U.S. PATENT DOCUMENTS

| | | | |
|---|---|---|---|
| 1,246,353 | 11/1917 | Thigpen | 411/203 |
| 1,473,579 | 11/1923 | Hart | 411/195 |
| 3,503,233 | 3/1970 | Russell et al. | 70/451 X |
| 3,985,008 | 10/1976 | Hart | 292/357 X |

FOREIGN PATENT DOCUMENTS

| | | | |
|---|---|---|---|
| 701879 | 1/1954 | United Kingdom | 292/356 |

*Primary Examiner*—Gary L. Smith
*Assistant Examiner*—Russell W. Illich
*Attorney, Agent, or Firm*—Lothrop & West

[57] ABSTRACT

A cylindrical lock on a door panel has an outside actuating lever and an outside nut. Torque from both the nut and the outside lever is transferred to a substantially planar torque plate engaging the door panel and having a central opening bounded by arcuate edge surfaces spaced away from external threads on the lock hub. The central opening is also bounded by chordal edge surfaces disposed next to chordal surfaces on the lock hub. The nut has chordal surfaces next to the chordal surfaces of the torque plate and has arcuate surfaces close to the arcuate surfaces of the torque plate, all of such surfaces being in the plane of the torque plate.

8 Claims, 9 Drawing Figures

CYLINDRICAL LOCK

BRIEF SUMMARY OF THE INVENTION

A lever-actuated cylindrical lock for installation in a circular-cylindrical bore in a door panel has a torque plate interengaging the lock hub and the door panel to transmit directly to the door panel torque imposed on the spindle within the hub and on a hub nut surrounding the hub. The torque plate has projections engaging the door panel and has a central opening in part bounded by arcuate edges concentric with and next to circular-cylindrical surfaces of the hub and hub nut and in part bounded by at least one chordal edge next to coplanar chordal surfaces on the hub and on the hub nut.

PRIOR ART

The prior art referred to in the description and the following U.s. Pat. Nos. are made of record:

2,018,093: Schlage, Oct. 22,1935
2,327,071: Schlage, Aug. 17, 1943
3,038,749: Check et al., June 12, 1962
3,241,874: Russell et al., Mar. 22, 1966
3,298,094: Russell et al., Jan. 17, 1967
3,503,233: Russell et al., Mar. 31, 1970
3,985,008: Hart, Oct. 12, 1976

While all of the foregoing are pertinent to the present disclosure, none of them meets the terms of the present claims in that excessive force on the actuating lever and on the exterior nut is not transmitted to the door panel by the mechanism disclosed herein.

BACKGROUND

The customary hinged door panel is held against swinging in its door frame by a cylindrical lock. A typical lock of this sort is shown in Walter R. Schlage U.S. Pat. No. 2,018,093 of Oct. 22, 1935. This kind of lock is inclusive of a chassis having a bolt retractor and disposed in a circular-cylindrical housing symmetrical about an axis. A circular-cylindrical bore through the thickness of the door panel receives the chassis housing and associated actuating parts, usually including inside and outside hand knobs. When manually rotated, the knobs operate the retractor within the chassis to withdraw a latch bolt slidable in a housing located in an edge bore in the door panel. The bolt housing is mechanically interengaged with the chassis housing by an axial sliding fit. Upon extreme rotation of the knob, some of the retractor parts abut each other or "bottom". Further knob torque is transferred to and tends to rotate the chassis housing within the door panel bore. Such torque is resisted and chassis rotation is normally prevented because of the interconnection of the retractor housing with the latch bolt housing.

When an actuating knob is replaced by an actuating lever, especially a relatively long, eccentric lever, much greater torque can be imposed on the chassis housing. The exertion of considerable force on the lever may be enough to distort or disrupt the connection between the chassis housing and the latch bolt housing and force rotation of the chassis housing in the cross bore. This damage to the lock may even destroy the security of the lock. It is therefore important effectively and simply to permit the satisfactory use of a lever actuator with a generally standard, cylindrical lock. That is accomplished by the device disclosed herein.

DETAILED DESCRIPTION

Figure 2:
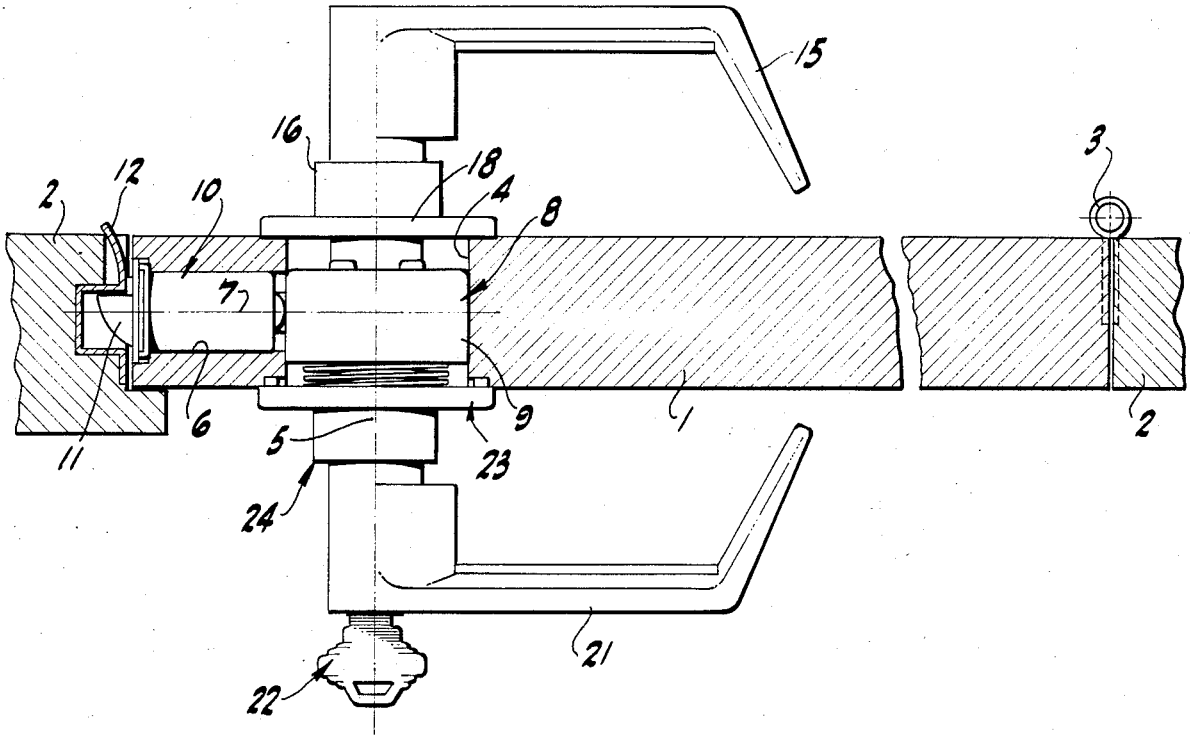
FIG. 2 is a cross-section, the plane of which is indicated by the line 2—2 of FIG. 1.
Figure 1:
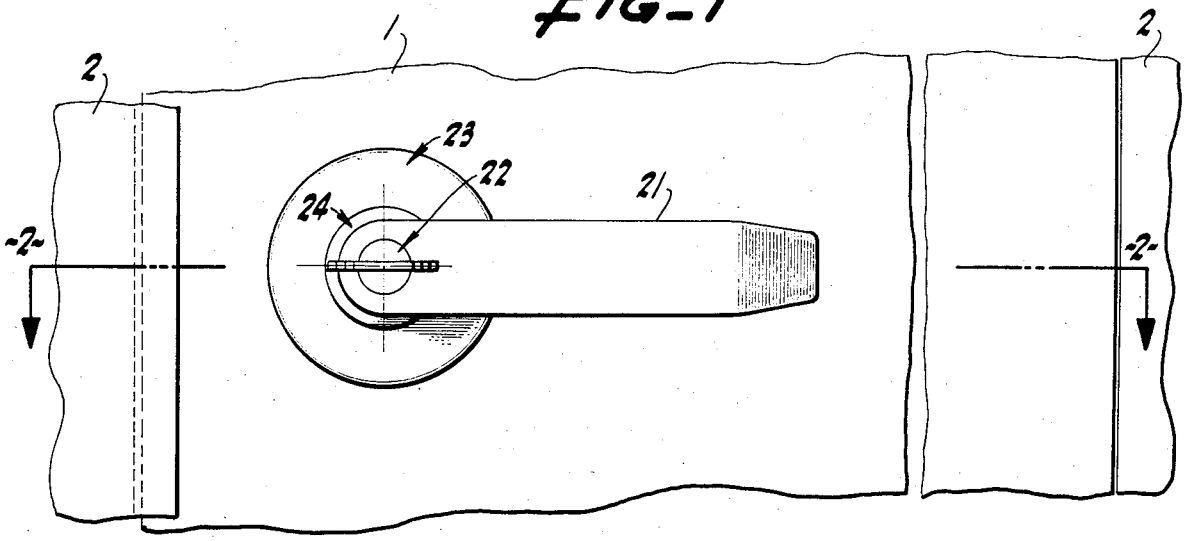
FIG. 1 is a side elevation of a cylindrical lock pursuant to the invention mounted on a door panel in a frame, various portions being broken away.
Figure 4:
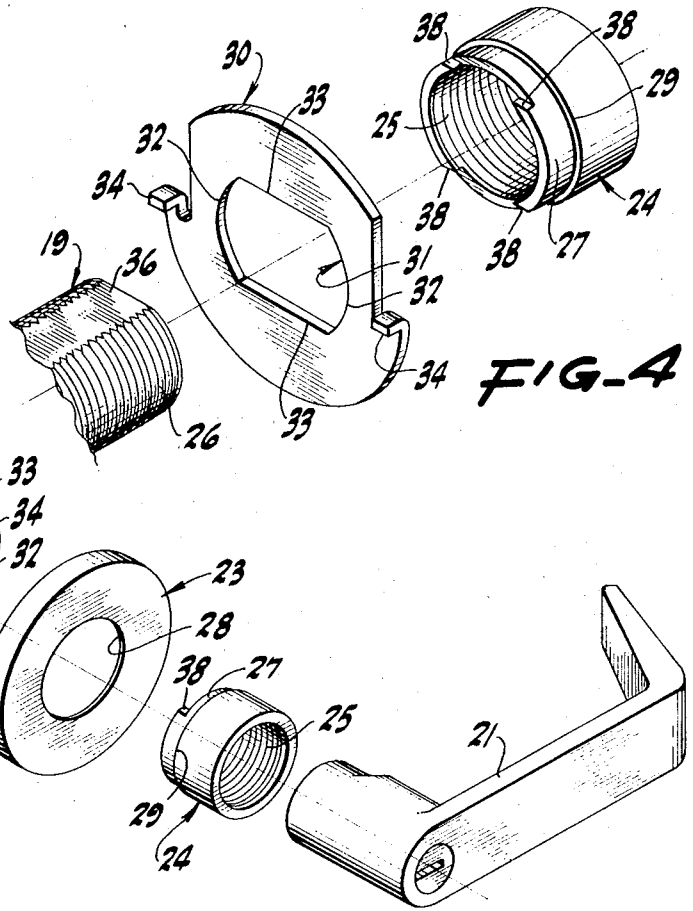
FIG. 4 is an exploded isometric view like FIG. 3, but from an opposite angle showing some parts of the present structure.
Figure 3:
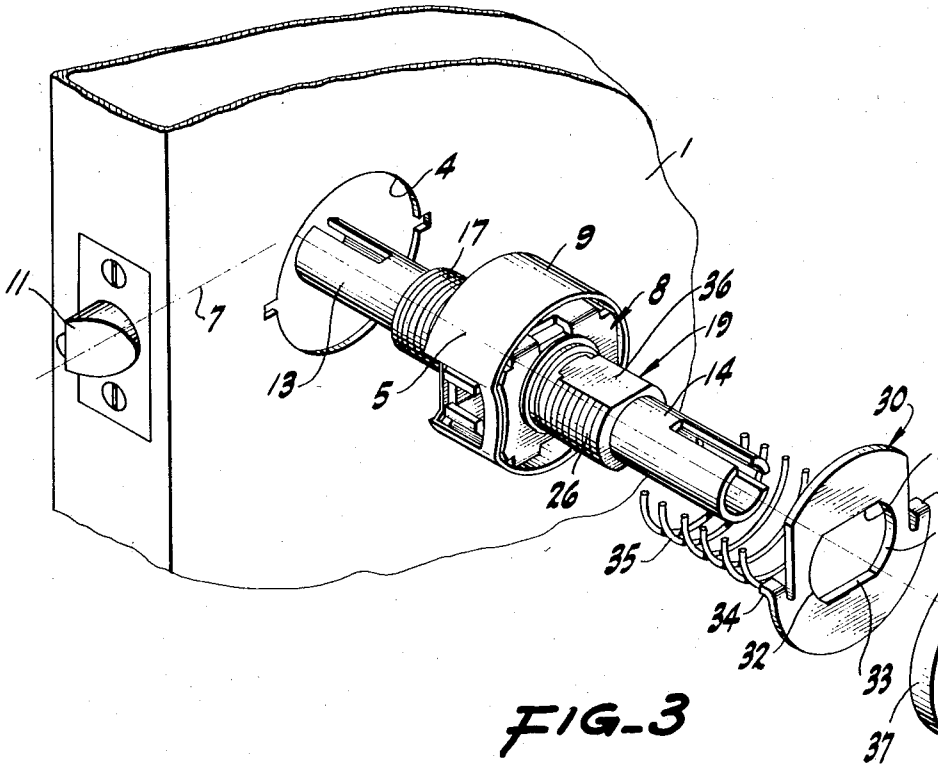
FIG. 3 is an exploded, isometric view of the structure of FIGS. 1 and 2.
Figure 5:
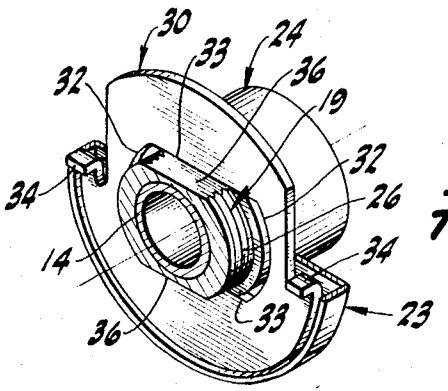
FIG. 5 is a view like FIG. 4, but with the parts assembled.
Figure 7:
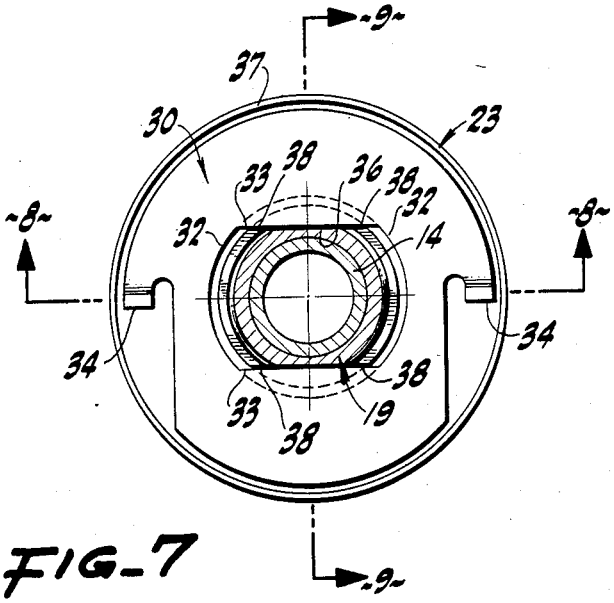
FIG. 7 is a cross-section, the plane of which is indicated by the line 7—7 of FIG. 6.
Figure 9:
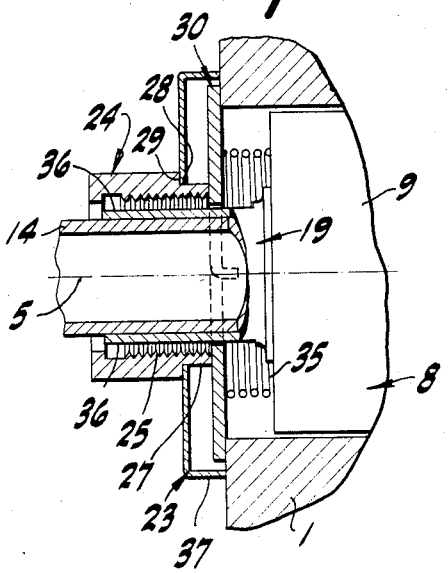
FIG. 9 is a cross-section, the plane of which is indicated by the line 9—9 of FIG. 7.
Figure 6:
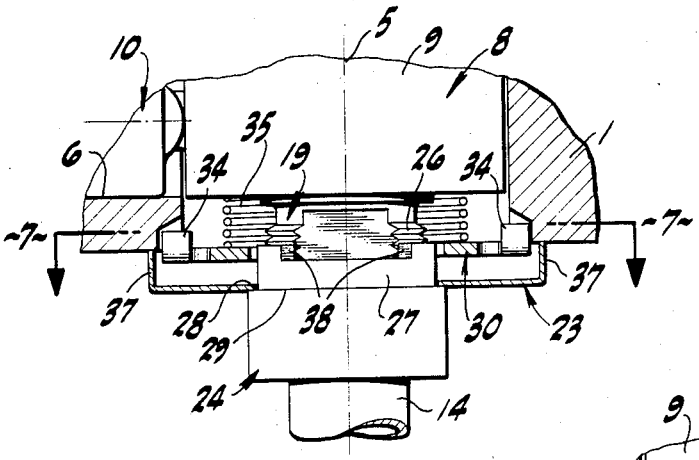
FIG. 6 is a plan of a lock structure pursuant to the present invention in assembled condition and with some portions broken away and with some parts in cross-section on a horizontal, axial plane.
Figure 8:
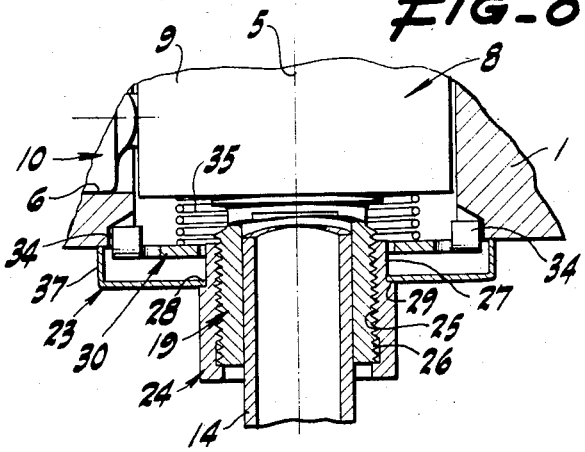
FIG. 8 is a view generally like FIG. 6, but with additional portions in cross-section on the plane 8—8 of FIG. 7.

A door panel 1 is mounted to swing on a door frame 2 by hinges 3. The door panel may be wood or composition, as shown in FIG. 2, or may be of hollow, metal construction, pursuant to standards defined by American National Standards Institute, New York, N. Y., published in 1971 as A115.2-1971, and shown in FIG. 3. In either case, the panel 1 is provided with a circular-cylindrical cross bore 4 symmetrical with an axis 5 normal to the plane of the door panel. There is also a circular-cylindrical, intersecting edge bore 6 arranged with its axis 7 normal to the axis 5. A standard lock inclusive of a chassis 8 incorporating a circular-cylindrical chassis housing 9 is disposed approximately concentrically within the cross bore 4. There is sufficient clearance so that the housing 9 is easily rotatable within the cross bore 4 about the axis 5.

A latch bolt housing 10 occupies the edge bore 6 and is interengaged with the chassis housing 9. This is usually done with stamped metal fingers slidably abutting with the margins of a cut-away edge portion of the chassis housing 9. The connected latch bolt housing 10 acts as a radially fixed torque arm for the chassis housing 9 for holding the chassis housing 9 against rotation about the axis 5. Within the bolt housing 10 a latch bolt 11 is mounted for mechanical retraction and spring extension in the usual way. The latch bolt 11 extends into and is withdrawn from a strike box 12 installed in the door frame 2. The general structure and installation are comparable to the disclosure in Schlage U.S. Pat. No. 2,018,093, noted above.

The retracting motion of the latch bolt is in response to standard structure (not shown) within the chassis housing 9 operating by rotation of either an inside spindle 13 or an outside spindle 14, both spindles being aligned along the axis 5. The inside spindle 13 can carry a knob (not shown) or an operating lever 15. The spindle 13 is located along the axis 5 by positioning of an inside nut 16 threaded onto an inside hub 17 surrounding the inside spindle 13 and extending from and secured to the chassis housing 9. An inside escutcheon 18 is mounted on the inside hub 17 and may be pressed against the door panel 1 by the inside nut 16.

Similarly, there is an outside hub 19 extending along the axis 5 from and secured to the chassis housing 9. The outside spindle 14 on the axis 5 is rotatable within the outside hub 19 and is connected by standard mechanism to retract the latch bolt 11 when the outside spindle 14 is rotated. At its outer extremity the outside spindle 14 carries an outside actuator lever 21 preferably having a key locking device 22 connected by appropriate means to hold the outside actuator 21 against turning about the axis 5 relative to the chassis housing 9.

An outside escutcheon 23 is axially movable to abut the door panel by rotation of a contacting outside nut 24 engaged by internal threads 25 with external threads 26 on the outside hub 19. A sleeve 27 integral with the outside nut 24 extends through a central opening 28 in the outside escutcheon 23 and provides a shoulder 29 to bear against the escutcheon 23.

In accordance with the present construction, a torque plate 30 of thin, planar construction, for the most part, is provided to lodge within the cup-like outside escutcheon 23 and to butt against the outside face of the door panel 1. The torque plate 30 is of slightly less overall diameter than the inside of the outside escutcheon 23, so that the torque plate 30 can shift radially (especially transversely) of the axis 5, if necessary, for interrelationship with the outside escutcheon 23, the outside hub 19, and for general accommodation and alignment. The torque plate 30 has a specially shaped central opening 31 allowing the transversely shiftable torque plate to move axially over and to engage with the outside hub 19. The opening 31 has a pair of axially flat, edge surfaces 32 arcuate about the axis 5 and somewhat larger in curvature than the outside diameter of the hub external threads 26. This allows for the limited transverse movement. Merging with the arcuate surfaces 32 are axially flat, straight, chordal edge surfaces 33. Extending axially away from the margin of the otherwise planar torque plate 30 are one or more projections 34.

In the assembly of this device for and prior to installation in a door panel, the inside lever 15, the inside nut 16 and the inside escutcheon 18 are initially omitted. A light, helical spring 35 is placed over the outside hub 19 and against the face of the chassis housing 9. The torque plate 30 is then placed axially over the outside hub 19 with the chordal edge surfaces 33 next to corresponding, parallel chordal flats 36 partly bounding the outside hub 19. The flats 36 extend between the partial, external threads 26 of the outside hub 19. The torque plate 30 is disposed with the projections 34 directed toward the door panel. The outer escutcheon 23 is then placed over the hub 19 and the torque plate 30 with the escutcheon rim 37 surrounding the plate 30 and facing the door panel. The outer escutcheon 23 and the torque plate 30 are manually urged axially against the force of the spring 35 toward the chassis housing 9 into and manually held in a selected axial location. This location is chosen so that when later installed in a door panel 1 of a particular one of a wide range of thicknesses, the chassis housing 9 will be approximately centered between the side faces of that particular panel.

The outside nut 24 is then easily threaded (by hand) upon the outside hub 19. The outside nut 24 is turned until special coplanar, parallel, chordal, flat surfaces or edges 38 formed on the end of the outside nut sleeve 27 are opposite and parallel to or face the chordal edge surfaces 33 of the torque plate 30 and also are parallel to and can align with the hub chordal flats 36, when they are all in the same transverse plane (the plane of the torque plate 30) normal to the axis 5. Since this relationship, when attained, prevents further rotation of the nut, the torque plate 30 is manually released as soon as the nut 24 is properly positioned. Upon such release, the spring 35 translates the torque plate 30 and outside escutcheon 23 outwardly a short distance along the axis 5 and until the torque plate 30 and outside escutcheon 28 abut the shoulder 29 of the outside nut 24. The hub-surrounding parts 23, 24 and 30 are thus made stable on the hub 19 both rotationally and axially.

The outside lever 21 and locking structure can be mounted on the outside spindle 14 at any convenient time. This outside sub-assembly is then moved to insert the chassis housing 9 axially into the cross bore 4, effectuating the customary transverse sliding interengagement of the chassis housing 9 with the bolt housing 10 and a similar interengagement of the chassis actuator with the latch bolt 11. The inside escutcheon 18 is then installed over the inwardly projecting inside spindle 13 and the inside hub 17. The inside nut 16 is threaded over the inside hub 17 and is tightened (usually by a special wrench) to force the inside escutcheon 18 against the door panel inside face and to draw the sub-assembly and the outside escutcheon 23 toward the panel 1 until the chassis 9 is approximately centered and a tight mounting is bad. In the assembled position, the chordal edge surface 33 of the torque plate 30 and the chordal edge surfaces 38 of the nut 24 all lie substantially in the same transverse chordaal plane parallel to the axis 5 and in which the flat surface 36 of the hub 19 also lies. The projections 34 either fit into prepared depressions in the door panel 1 or force themselves into the material of a relatively soft panel.

Removal of the structures is by an inverse order of disassembly, beginning on the inside. From the outside, no disassembly is possible. Torque in either direction on the outside lever 21 is transmitted to and through the chassis housing 9 and is resisted in part by the latch bolt housing 10, as usual. But excessive torque, especially potentially destructive extra torque, is transmitted to the outside hub 19 and by the surface 36 and 33 to and through the torque plate 30 in a coplanar fashion and finally to the door panel 1 itself. Torque in either direction applied to the outside nut 24 (by a wrench or the like) is similarly transmitted through the surfaces 38 and 33 to the torque plate 30 in a coplanar fashion to the door panel 1.

This arrangement permits the use of the customary lock constructed for knob operation but permits use of a lever actuator without disruptive overloading by extra torque that can be imposed through a lever.

We claim:

1. A cylindrical lock adapted to be mounted on a door panel having a bore that is circular-cylindrical about an axis, comprising:

a lock chassis adapted to fit within said bore and turntable therein about said axis, a hub fixed to and projecting from said chassis along said axis and having a circular-cylindrical contour and external threads, means on said hub defining a chordal flat surface disposed on one side of and parallel to said axis, a nut having a circular-cylindrical external surface and having internal threads adapted to engage said threads of said hub, means on said nut defining separate chordal flat surfaces disposed on said one side of said axis and disposed to lie in transverse alignment with said chordal flat surface on said hub and with all of said flat surfaces in a single plane parallel to said axis, a torque plate positionable over said hub and lying in a plane normal to said axis, said torque plate having a transversely elongated central opening having a chordal edge adapted substantially to overlie and slidingly engage said chordal flat surface of said hub and to overlie said chordal flat surfaces of said nut, said opening being of greater transverse extent than the diameter of said hub to allow relative transverse motion between said torque plate and said hub, said central opening having a pair of arcuate edges merging with said chordal edge and disposed substantially to overlie said external surface of said nut, and means on said torque plate adapted to project axially into said door panel.

2. A device as in claim 1 including means on said hub defining a symmetrical second chordal flat surface disposed on the other side of said axis and parallel to said first chordal flat surface, and said central opening having a symmetrical second chordal edge adapted substantially to overlie said second chordal flat surface of said hub and merging with said arcuate edges.

3. A device as in claim 1 in which said nut surface has a predetermined radius, and said arcuate edges have a radius larger than said predetermined radius and allowing for substantial transverse shifting between said nut and said torque plate.

4. A device as in claim 3 in which said larger radius allows disposition of at least part of said nut between said hub and said torque plate.

5. A device as in claim 1 includng means on said nut adapted to urge said torque plate in any transverse position thereof toward said door panel when said nut moves toward said door panel.

6. A device as in claim 1 including an escutcheon surrounding said nut and movable axially toward said door panel, a torque plate surrounding said nut and shiftable transversely of and toward said door panel, and means on said nut for moving said escutcheon and said torque plate axially toward said door panel when said nut moves axially toward said door panel.

7. A device as in claim 1 including a spring engaging said torque plate and said lock chassis for urging said torque plate and said lock chassis axially apart.

8. For use in a cylindrical lock, a hub having threads and having a chordal flat surface, a torque plate having a transversely elongated central opening of greater diameter than the diameter of said hub and adapted to surround said hub, said central opening in part bein defined by a chordal flat surface adapted substantially to abut said chordal flat surface of said hub and said central opening in part being defined by an arcuate surface separated from said threads by a space, and a nut having threads engageable with said threads on said hub and having portions adapted to lie in parts only of said space to leave transverse clearance, said portions having a pair of chordal flat surfaces adapted substantially to abut and shift transversely relative to said chordal flat surface of said opening.

* * * * *